US008911221B2

(12) United States Patent
Cheng et al.

(10) Patent No.: US 8,911,221 B2
(45) **Date of Patent: *Dec. 16, 2014**

(54) LEAF BLOWER

(75) Inventors: On Hing Cheng, Shenzhen (CN); Jicheng Pan, Shenzhen (CN); Chun Lei Zhang, Shenzhen (CN)

(73) Assignee: Johnson Electric S.A., Murten (CH)

( * ) Notice: Subject to any disclaimer, the term of this patent is extended or adjusted under 35 U.S.C. 154(b) by 617 days.

This patent is subject to a terminal disclaimer.

(21) Appl. No.: 13/045,139

(22) Filed: Mar. 10, 2011

(65) Prior Publication Data

US 2011/0223048 A1 Sep. 15, 2011

(30) Foreign Application Priority Data

Mar. 12, 2010 (CN) ..... 2010 1 0123265

(51) Int. Cl.
*F04B 35/04* (2006.01)
*F04D 25/08* (2006.01)

(52) U.S. Cl.
CPC ..... *F04D 25/082* (2013.01)
USPC ..... 417/423.7; 310/198

(58) Field of Classification Search
USPC ..... 417/423.1, 423.7, 423.8; 15/405, 412, 15/413; 310/184–186, 158, 198
See application file for complete search history.

(56) References Cited

U.S. PATENT DOCUMENTS

| | | | | |
|---|---|---|---|---|
| 3,909,647 | A * | 9/1975 | Peterson | 310/156.12 |
| 3,942,055 | A * | 3/1976 | Hoffmeyer | 310/216.111 |
| 4,140,935 | A * | 2/1979 | Braun et al. | 310/224 |
| 4,808,868 | A * | 2/1989 | Roberts | 310/68 R |
| 6,788,020 | B1 * | 9/2004 | Pollock et al. | 318/599 |
| 7,078,843 | B2 * | 7/2006 | Du et al. | 310/216.091 |
| 7,230,361 | B2 * | 6/2007 | Hirzel | 310/216.074 |
| 7,406,744 | B2 * | 8/2008 | Bruneau | 15/413 |
| 2005/0184612 | A1 * | 8/2005 | Cros et al. | 310/158 |

* cited by examiner

*Primary Examiner* — Devon Kramer
*Assistant Examiner* — Amene Bayou
(74) *Attorney, Agent, or Firm* — Muncy, Geissler, Olds & Lowe, P.C.

(57) ABSTRACT

A blower assembly for a leaf blower has a case, a motor, an impeller driven by the motor, and an axial fan driven by the motor. The axial fan and the impeller are connected to opposite ends of the motor. The case has an air inlet, an air outlet and an air channel communicating the air inlet with the air outlet. The impeller is disposed inside the air channel to move air through the air channel from the air inlet to the air outlet. The axial fan is arranged to generate an axial flow of air towards the motor to cool the motor.

11 Claims, 7 Drawing Sheets

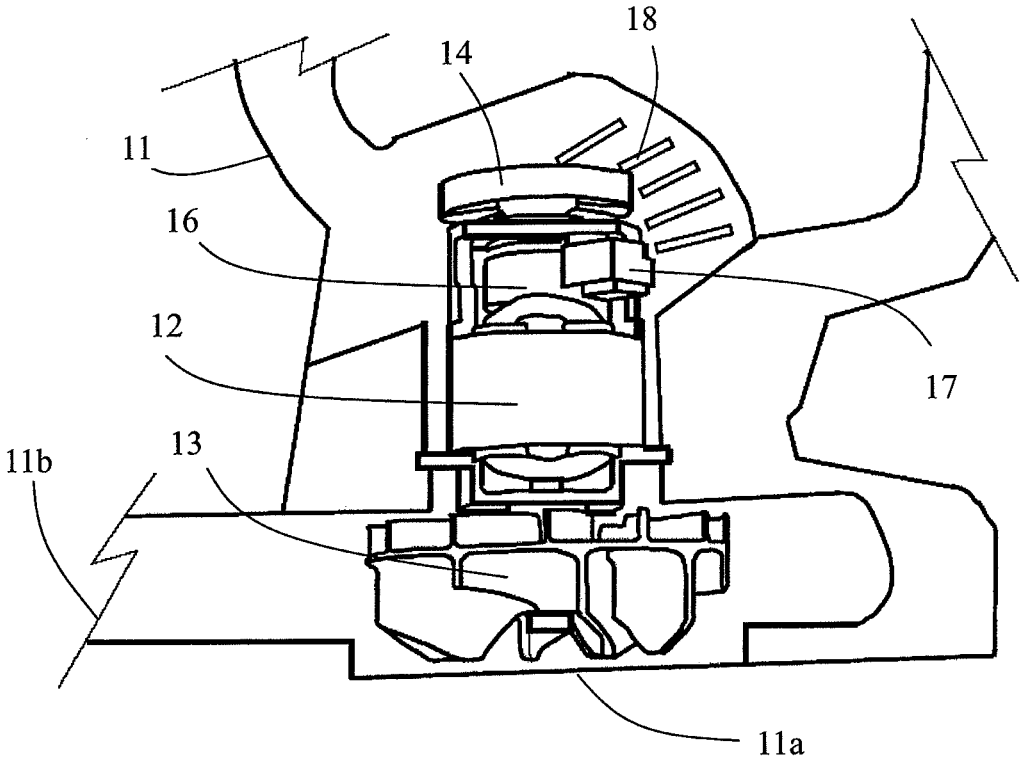
FIG.. 2
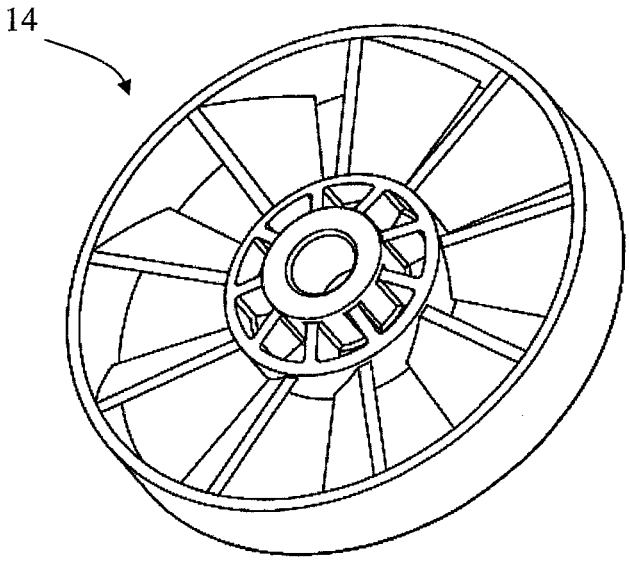
FIG. 3

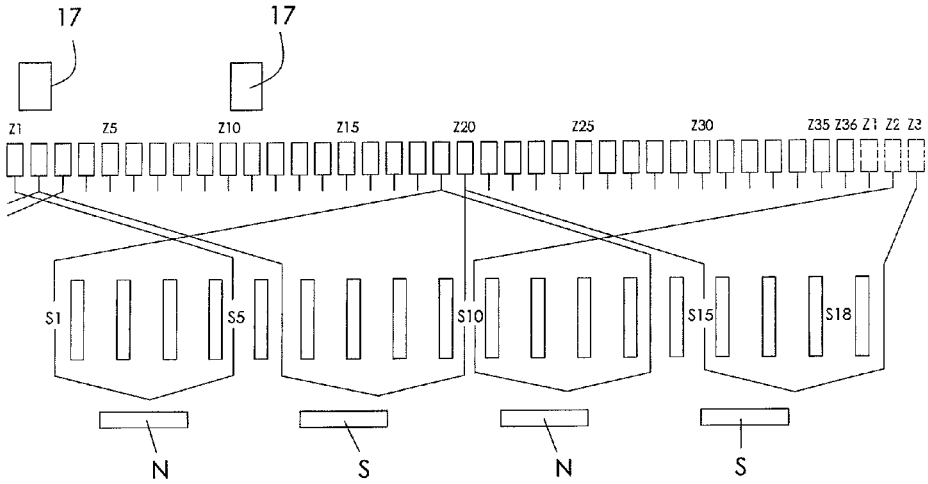

FIG. 7

| segment | winding slot | | segment | winding slot | | segment | winding slot | | segment | winding slot | | segment |
|---|---|---|---|---|---|---|---|---|---|---|---|---|
| | in | out | | in | out | | in | out | | in | out | |
| $Z_1$ | $S_5$ | $S_1$ | $Z_{19}$ | $S_{14}$ | $S_{10}$ | $Z_2$ | $S_6$ | $S_{10}$ | $Z_{20}$ | $S_{15}$ | $S_1$ | $Z_3$ |
| $Z_3$ | $S_6$ | $S_2$ | $Z_{21}$ | $S_{15}$ | $S_{11}$ | $Z_4$ | $S_7$ | $S_{11}$ | $Z_{22}$ | $S_{16}$ | $S_2$ | $Z_5$ |
| $Z_5$ | $S_7$ | $S_3$ | $Z_{23}$ | $S_{16}$ | $S_{12}$ | $Z_6$ | $S_8$ | $S_{12}$ | $Z_{24}$ | $S_{17}$ | $S_3$ | $Z_7$ |
| $Z_7$ | $S_8$ | $S_4$ | $Z_{25}$ | $S_{17}$ | $S_{13}$ | $Z_8$ | $S_9$ | $S_{13}$ | $Z_{26}$ | $S_{18}$ | $S_4$ | $Z_9$ |
| $Z_9$ | $S_9$ | $S_5$ | $Z_{27}$ | $S_{18}$ | $S_{14}$ | $Z_{10}$ | $S_{10}$ | $S_{14}$ | $Z_{28}$ | $S_1$ | $S_5$ | $Z_{11}$ |
| $Z_{11}$ | $S_{10}$ | $S_6$ | $Z_{29}$ | $S_1$ | $S_{15}$ | $Z_{12}$ | $S_{11}$ | $S_{15}$ | $Z_{30}$ | $S_2$ | $S_6$ | $Z_{13}$ |
| $Z_{13}$ | $S_{11}$ | $S_7$ | $Z_{31}$ | $S_2$ | $S_{16}$ | $Z_{14}$ | $S_{12}$ | $S_{16}$ | $Z_{32}$ | $S_3$ | $S_7$ | $Z_{15}$ |
| $Z_{15}$ | $S_{12}$ | $S_8$ | $Z_{33}$ | $S_3$ | $S_{17}$ | $Z_{16}$ | $S_{13}$ | $S_{17}$ | $Z_{34}$ | $S_4$ | $S_8$ | $Z_{17}$ |
| $Z_{17}$ | $S_{13}$ | $S_9$ | $Z_{35}$ | $S_4$ | $S_{18}$ | $Z_{18}$ | $S_{14}$ | $S_{18}$ | $Z_{36}$ | $S_5$ | $S_9$ | $Z_1$ |

FIG. 8

| segment | winding slot | | segment | winding slot | | segment | winding slot | | segment | winding slot | | segment |
|---|---|---|---|---|---|---|---|---|---|---|---|---|
| | in | out | | in | out | | in | out | | in | out | |
| $Z_1$ | $S_7$ | $S_1$ | $Z_{27}$ | $S_{20}$ | $S_{14}$ | $Z_2$ | $S_8$ | $S_{14}$ | $Z_{28}$ | $S_{21}$ | $S_1$ | $Z_3$ |
| $Z_3$ | $S_8$ | $S_2$ | $Z_{29}$ | $S_{21}$ | $S_{15}$ | $Z_4$ | $S_9$ | $S_{15}$ | $Z_{30}$ | $S_{22}$ | $S_2$ | $Z_5$ |
| $Z_5$ | $S_9$ | $S_3$ | $Z_{31}$ | $S_{22}$ | $S_{16}$ | $Z_6$ | $S_{10}$ | $S_{16}$ | $Z_{32}$ | $S_{23}$ | $S_3$ | $Z_7$ |
| $Z_7$ | $S_{10}$ | $S_4$ | $Z_{33}$ | $S_{23}$ | $S_{17}$ | $Z_8$ | $S_{11}$ | $S_{17}$ | $Z_{34}$ | $S_{24}$ | $S_4$ | $Z_9$ |
| $Z_9$ | $S_{11}$ | $S_5$ | $Z_{35}$ | $S_{24}$ | $S_{18}$ | $Z_{10}$ | $S_{12}$ | $S_{18}$ | $Z_{36}$ | $S_{25}$ | $S_5$ | $Z_{11}$ |
| $Z_{11}$ | $S_{12}$ | $S_6$ | $Z_{37}$ | $S_{25}$ | $S_{19}$ | $Z_{12}$ | $S_{13}$ | $S_{19}$ | $Z_{38}$ | $S_{26}$ | $S_6$ | $Z_{13}$ |
| $Z_{13}$ | $S_{13}$ | $S_7$ | $Z_{39}$ | $S_{26}$ | $S_{20}$ | $Z_{14}$ | $S_{14}$ | $S_{20}$ | $Z_{40}$ | $S_1$ | $S_7$ | $Z_{15}$ |
| $Z_{15}$ | $S_{14}$ | $S_8$ | $Z_{41}$ | $S_1$ | $S_{21}$ | $Z_{16}$ | $S_{15}$ | $S_{21}$ | $Z_{42}$ | $S_2$ | $S_8$ | $Z_{17}$ |
| $Z_{17}$ | $S_{15}$ | $S_9$ | $Z_{43}$ | $S_2$ | $S_{22}$ | $Z_{18}$ | $S_{16}$ | $S_{22}$ | $Z_{44}$ | $S_3$ | $S_9$ | $Z_{19}$ |
| $Z_{19}$ | $S_{16}$ | $S_{10}$ | $Z_{45}$ | $S_3$ | $S_{23}$ | $Z_{20}$ | $S_{17}$ | $S_{23}$ | $Z_{46}$ | $S_4$ | $S_{10}$ | $Z_{21}$ |
| $Z_{21}$ | $S_{17}$ | $S_{11}$ | $Z_{47}$ | $S_4$ | $S_{24}$ | $Z_{22}$ | $S_{18}$ | $S_{24}$ | $Z_{48}$ | $S_5$ | $S_{11}$ | $Z_{23}$ |
| $Z_{23}$ | $S_{18}$ | $S_{12}$ | $Z_{49}$ | $S_5$ | $S_{25}$ | $Z_{24}$ | $S_{19}$ | $S_{25}$ | $Z_{50}$ | $S_6$ | $S_{12}$ | $Z_{25}$ |
| $Z_{25}$ | $S_{19}$ | $S_{13}$ | $Z_{51}$ | $S_6$ | $S_{26}$ | $Z_{26}$ | $S_{20}$ | $S_{26}$ | $Z_{52}$ | $S_7$ | $S_{13}$ | $Z_1$ |

FIG. 9

| Segment | Number of turns | segment | Number of turns | Segment | Number of turns | segment |
|---|---|---|---|---|---|---|
| $Z_1$ | 10 | $Z_{19}$ | 10 | $Z_{37}$ | 10 | $Z_2$ |
| $Z_2$ | 10 | $Z_{20}$ | 10 | $Z_{38}$ | 10 | $Z_3$ |
| $Z_3$ | 10 | $Z_{21}$ | 10 | $Z_{39}$ | 10 | $Z_4$ |
| $Z_4$ | 10 | $Z_{22}$ | 10 | $Z_{40}$ | 10 | $Z_5$ |
| $Z_5$ | 10 | $Z_{23}$ | 10 | $Z_{41}$ | 10 | $Z_6$ |
| $Z_6$ | 10 | $Z_{24}$ | 10 | $Z_{42}$ | 10 | $Z_7$ |
| $Z_7$ | 10 | $Z_{25}$ | 10 | $Z_{43}$ | 10 | $Z_8$ |
| $Z_8$ | 10 | $Z_{26}$ | 10 | $Z_{44}$ | 10 | $Z_9$ |
| $Z_9$ | 10 | $Z_{27}$ | 10 | $Z_{45}$ | 10 | $Z_{10}$ |
| $Z_{10}$ | 10 | $Z_{28}$ | 10 | $Z_{46}$ | 10 | $Z_{11}$ |
| $Z_{11}$ | 10 | $Z_{29}$ | 10 | $Z_{47}$ | 10 | $Z_{12}$ |
| $Z_{12}$ | 10 | $Z_{30}$ | 10 | $Z_{48}$ | 10 | $Z_{13}$ |
| $Z_{13}$ | 10 | $Z_{31}$ | 10 | $Z_{49}$ | 10 | $Z_{14}$ |
| $Z_{14}$ | 10 | $Z_{32}$ | 10 | $Z_{50}$ | 10 | $Z_{15}$ |
| $Z_{15}$ | 10 | $Z_{33}$ | 10 | $Z_{51}$ | 10 | $Z_{16}$ |
| $Z_{16}$ | 10 | $Z_{34}$ | 10 | $Z_{52}$ | 10 | $Z_{17}$ |
| $Z_{17}$ | 10 | $Z_{35}$ | 10 | $Z_{53}$ | 10 | $Z_{18}$ |
| $Z_{18}$ | 10 | $Z_{36}$ | 10 | $Z_{54}$ | 10 | $Z_1$ |

FIG. 10

LEAF BLOWER

CROSS REFERENCE TO RELATED APPLICATIONS

This non-provisional patent application claims priority under 35 U.S.C. §119(a) from Patent Application No. 201010123265.2 filed in The People's Republic of China on Mar. 12, 2010.

STATOR OF THE INVENTION

The present invention relates to a blower and in particular to a leaf blower.

BACKGROUND OF THE INVENTION

A leaf blower comprises a case, a high power motor mounted inside the case, and a centrifugal fan (also known as an impeller) driven by the motor. An inlet and an outlet are formed in the case. Air is drawn into the inlet and expelled from the outlet by the centrifugal fan. Traditional leaf blowers are heavy and large in size since the high power motor is heavy and large. The motor is hot during operation since it is a high power motor.

Hence, there is a desire for blower, such as a leaf blower, which incorporates a high power motor that has a lighter weight or a higher power density.

SUMMARY OF THE INVENTION

Accordingly, in one aspect thereof, the present invention provides a blower comprising: a case; a motor; an impeller driven by the motor, and an axial fan driven by the motor, the axial fan and the impeller being disposed at respective axial ends of the motor, wherein the case comprises an air inlet, an air outlet and an air channel communicating the air inlet with the air outlet, the impeller being disposed inside the air channel, and wherein the axial fan is arranged to generate an axial flow of air towards the motor.

Preferably, the motor is a universal motor having four stator poles.

Preferably, the motor comprises a stator with stator windings and a rotor with rotor windings, and wherein the stator comprises a stator core which comprises a yoke, two primary poles about which the stator windings are wound and two auxiliary poles without windings wound thereon, the primary poles and auxiliary poles being alternately arranged on an inner side of the yoke in a circumferential direction thereof; whereby when the stator windings are electrified, the polarity of each primary pole is opposite to the polarity of each auxiliary pole.

According to a second aspect, the present invention provides a blower comprising: a case, a motor and an impeller driven by the motor, wherein the case comprises an air inlet, an air outlet and an air channel communicating the air inlet with the air outlet, the impeller being disposed inside the air channel, wherein the motor comprises a stator and a rotor rotatably mounted to the stator, the stator comprising a stator core which comprises a yoke, P primary poles with stator windings wound thereon and P auxiliary poles, the primary poles and auxiliary poles being alternately arranged on the radially inner side of the yoke in a circumferential direction thereof; and when the stator windings are electrified, P primary magnetic poles and P auxiliary magnetic poles are respectively formed at the primary poles and auxiliary poles respectively, the polarity of the primary magnetic poles being opposite to the polarity of the auxiliary magnetic poles, P being an integer greater than 1.

Preferably, there are no stator windings wound about the auxiliary poles.

Preferably, additional windings are wound on the auxiliary poles, the additional windings wound about each auxiliary pole having less turns than the stator windings wound about each primary pole.

Preferably, the outer diameter D of the rotor core and the minimum outer diameter Y of the stator core meets the following equation: $D/Y>0.6$.

Preferably, the yoke comprises P primary yoke portions from which the primary poles extend inwardly and P auxiliary yoke portions from which the auxiliary poles extend inwardly.

Preferably, holes are formed in the auxiliary yoke portions.

Preferably, the radial thickness of each primary yoke portion is larger than the radial thickness of each auxiliary yoke portion.

Preferably, each of the primary poles and auxiliary poles comprises a neck portion inwardly extending from the yoke and an arc shape pole shoe which confronts the rotor; the radial length of the neck portion of each primary pole is larger than the radial length of the neck portion of each auxiliary pole.

Preferably, the blower comprises an axial fan driven by the motor to generate an axial flow of air towards the motor, the axial fan and the impeller being respectively disposed at opposite ends of the motor.

Preferably, the stator comprises 2P poles where P is an integer greater than one, and the rotor comprises a shaft, a rotor core and a commutator fixed onto the shaft; and wherein the commutator comprises m segments where m is an even integer greater than P, every two adjacent segments being electrically connected together by a winding unit so that the rotor winding comprises m winding units; at least one of the winding units comprises P coils connected in series; and each coil of each winding unit is directly connected to a corresponding two of the segments.

Preferably, m is a multiple of P, and the rotor core comprises n teeth, wherein n is a multiple of P and is greater than P.

By implementing the invention, the motor has higher power density. The blower is lighter and has reduced size. In preferred embodiments, the high power motor is cooled by an axial fan.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

FIG. 2 illustrates the inner structure of the leaf blower of FIG. 1;

FIG. 3 illustrates an axial fan of the leaf blower of FIG. 2;

FIG. 7 illustrates a winding diagram for the motor of FIG. 4A;

FIG. 8 illustrates a winding table for the motor of FIG. 4A;

FIG. 9 illustrates a winding table for another motor according to a fourth embodiment; and FIG. 10 illustrates a winding table for a further motor according to a fifth embodiment.

DETAILED DESCRIPTION OF THE PREFERRED EMBODIMENTS

Figure 1:
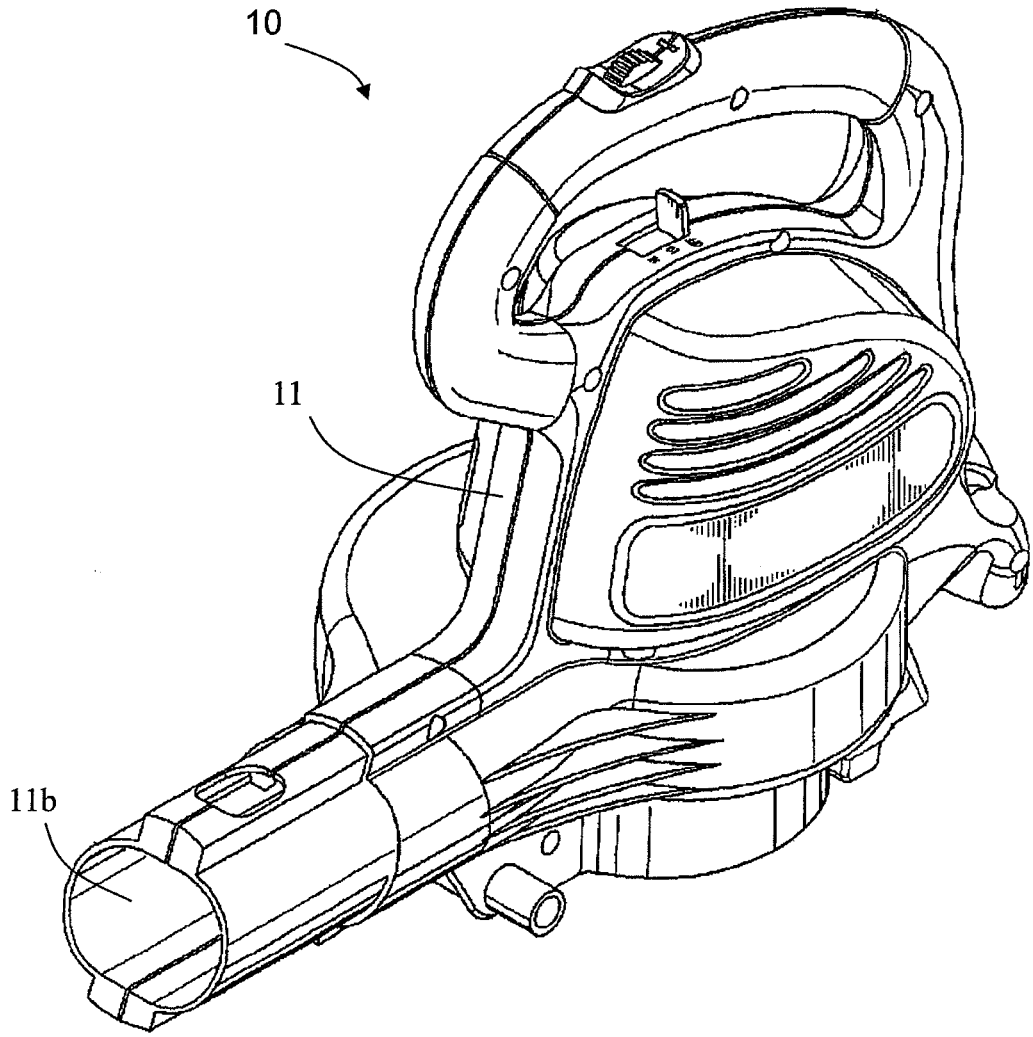
FIG. 1 illustrates a leaf blower according to a first embodiment of the present invention.

As shown in FIG. 1 to FIG. 3, the leaf blower 10 according to a first embodiment comprises a case 11, a motor 12, a centrifugal impeller 13 and an axial fan 14 arranged inside the case 11. The motor 12 has a shaft that passes through the motor. The impeller 13 and the axial fan 14 are fixed to respective ends of the shaft so as to be driven by the motor. The case 11 is made of plastics material, comprising a first half and a second half that are closed together to accommodate the motor 12, impeller 13 and the fan 14.

The case 11 has an air inlet 11*a*, an air outlet 11*b*, and an air channel that is formed inside the case 11 and communicates the air inlet 11*a* with the air outlet 11*b*. The impeller 13 is disposed in the air channel, preferably near the air inlet 11*a*. High pressure air flow is generated by the impeller 13 when the motor 12 operates. The air flow is routed from the air inlet 11*a* to the air outlet 11*b*. The axial fan 14 generates an axial air flow when the motor operates. The axial air flow is directed to the main body of the motor 12 to cool down the motor, and then to the air channel. Preferably, the case 11 has an auxiliary air inlet 18 near the axial fan 14, so that the axial fan can draw in fresh air through the auxiliary air inlet 18 to cool the motor 12.

Figure 4A:
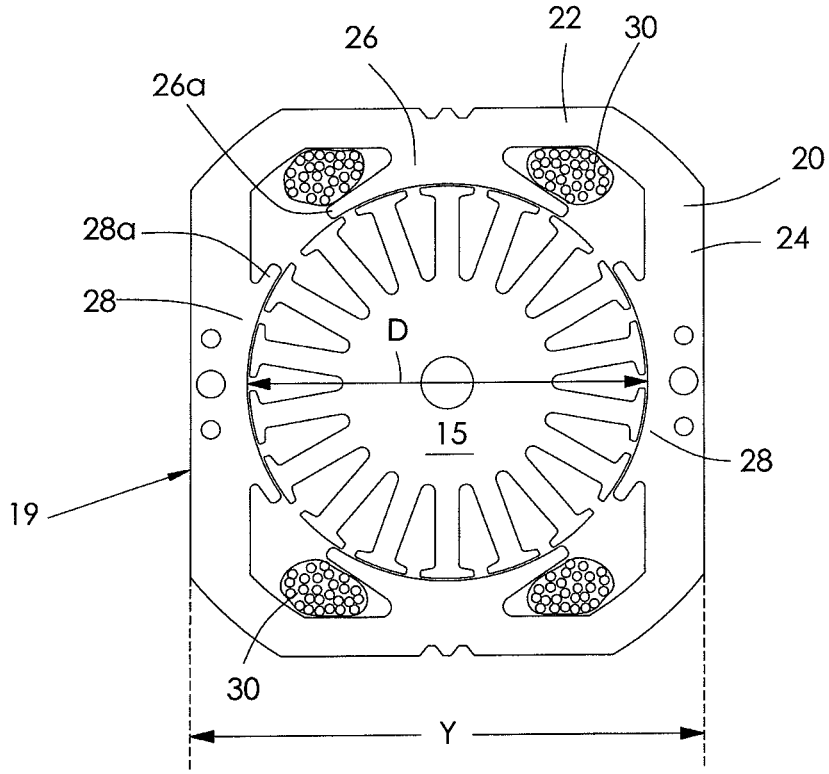
FIG. 4A is a cross sectional view of a motor of the leaf blower.

In the preferred embodiment shown in FIG. 4A, the motor 12 is a universal motor, comprising a stator 19 and a rotor 15 rotatably mounted to the stator 19. The stator 19 comprises a stator core 20 and stator windings 30. The stator core 20 is formed by stacking laminations in the axial direction. The stator core 20 comprises a frame-like yoke, two primary poles 26 and two auxiliary poles 28 extending radially inwardly from the yoke. The yoke comprises a pair of primary yoke portions 22 and a pair of auxiliary yoke portions 24. The primary yoke portions 22 and the auxiliary yoke portions 24 are alternately arranged in the circumferential direction of the motor and disposed around the rotor 15. Each primary pole 26 comprises a neck portion extending inwardly from a corresponding primary yoke portion 22 and a pole shoe formed at the inner end of the neck portion confronting the rotor. Each auxiliary pole 28 comprises a pole shoe confronting the rotor 15 and optionally a neck portion extending radially and connecting the pole shoe to the auxiliary yoke portion 22. Each pole shoe has an arc surface facing the rotor 15. The stator windings 30 comprises a first primary stator winding and a second primary stator winding, each of which is wound about the neck portion of a respective primary pole 26.

In this embodiment, for the ease of accommodating large stator windings 30, the radial length of the neck portion of the primary poles 26 is larger than the neck portion of the auxiliary poles 28, and the width of the neck portion of the primary poles 26 is smaller than the width of the neck portion of the auxiliary poles 28. Preferably, the radial thickness of the primary yoke portions 22 is smaller than the radial thickness of the auxiliary yoke portion 24. The distance from each circumferential tip portion 26*a* of each primary pole shoe to the corresponding primary yoke portion 22 is larger than the distance from the circumferential tip portion 28*a* of each auxiliary pole shoe to the corresponding auxiliary yoke portion 24. By implementing this design, there is enough space for receiving the stator windings 30.

Preferably, the ratio of the outer diameter D of the rotor 15 to the smallest outer diameter Y of the stator 19 (D/Y) is larger than 0.6, and is preferably larger than 0.7. In this specification and the appended claims, the outer diameter D is defined by the outer diameter of the rotor core, and the smallest outer diameter Y is defined by the shortest path that passes through the center of the stator 19 and connects two opposite outside surfaces of the stator core 20.

Figure 4B:
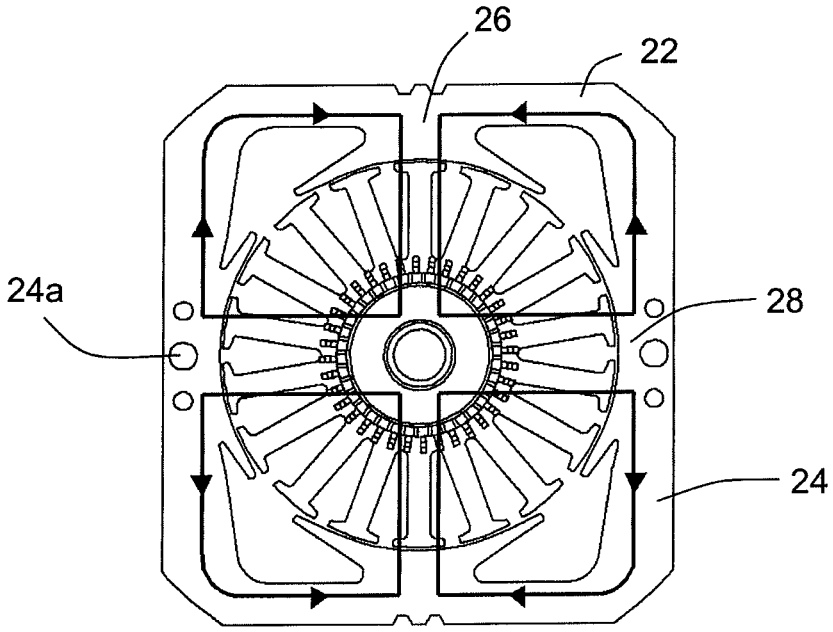
FIG. 4B illustrates the magnetic flux path of the motor of FIG. 4A.

As shown in FIGS. 4A and 4B, when the stator windings 30 are electrified, primary magnetic poles are formed at the primary poles 26. The polarity of the primary magnetic poles is controllable by changing the current direction of the stator windings 30. When the polarity at the primary poles 26 are the same, auxiliary magnetic poles with opposite polarity are induced at the auxiliary poles 28 and the magnetic flux path is indicated by arrows in FIG. 4B. The motor 12 operates as a four pole motor, rather than a two pole motor. Compared with the traditional motor of the same size that usually has two stator windings and has only two poles, the four pole motor according to this invention will have better performance. In other words, by implementing the invention, a motor of equivalent performance can be lighter and smaller than a traditional universal motor, and the leaf blower of the invention is also lighter and smaller.

The rotor 15 comprises a shaft, a rotor core fixed on the shaft, a commutator 16 (FIG. 2) fixed on the shaft adjacent the rotor core, and a plurality of rotor windings (not shown) wound around teeth of the rotor core. Lead wires of the rotor windings are connected to corresponding terminals of segments of the commutator. Current is directed to the rotor windings from the brushes 17 (FIG. 2) via the commutator 16. When the stator windings 30 and the rotor windings are electrified, the rotor 15 rotates about the shaft.

In this embodiment, the auxiliary poles 28 are salient poles. There are no windings wound about the auxiliary poles 28. Holes 24*a* (FIG. 4B) for mounting motor bearing brackets (FIG. 2) are formed in the auxiliary yoke portion 24. Alternatively, there are auxiliary windings wound about the auxiliary poles 28, and the auxiliary windings wound about each auxiliary pole 28 have less turns than the stator windings wound about each primary pole 26. As a further alternative, the auxiliary poles 28 may be non-salient poles.

Figure 5:
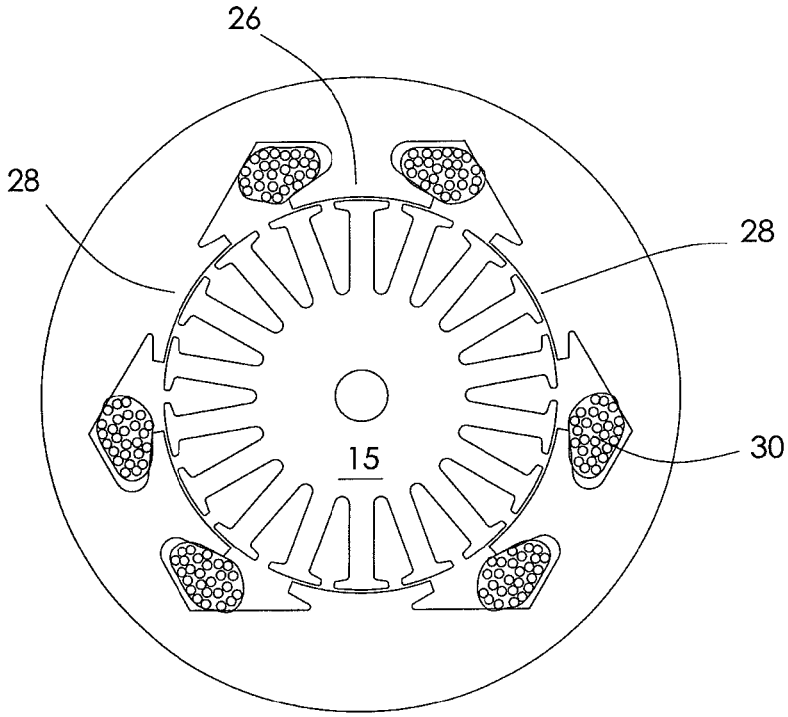
FIG. 5 is a cross sectional view of a motor according to a second embodiment of the present invention.
Figure 6:
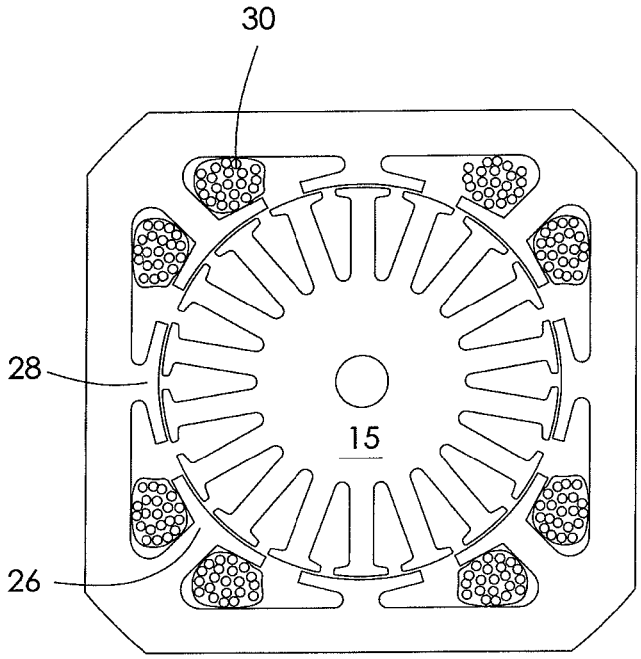
FIG. 6 is a cross sectional view of a motor according to a third embodiment of the preset invention.

Alternatively, the motor according to further embodiments of the present invention, may be a six pole motor that comprises three primary poles with stator windings and three auxiliary poles without windings, as shown in FIG. 5, or an eight pole motor that comprises four primary poles with stator windings and four auxiliary poles without windings, as shown in FIG. 6, etc. In summary, the motor according to the present invention can be described a 2P pole motor that comprises P primary poles, P auxiliary poles, and P primary stator windings wound about the primary poles. The stator yoke may be cylindrical or polygonal.

FIG. 7 and FIG. 8 each illustrate the connection relationships of the rotor windings. FIG. 7 is a winding diagram in which, the top row represents two brushes 17 supported by the stator, the second row represents the thirty-six segments $Z_1$~$Z_{36}$ of the commutator, the third row represents the eighteen teeth of the rotor core and eighteen winding slots $S_1$~$S_{18}$ formed by the teeth, and the fourth row represents the four poles of the stator.

FIG. 8 is a winding table showing the coil connections. In the winding procedure, the wire starts from segment $Z_1$, and then passes through winding slots $S_5$ and $S_1$ repeatedly to form a coil which winds about the four teeth between the winding slots $S_5$ and $S_1$, and then the wire is connected to segment $Z_{19}$. Then, the wire starting from segment $Z_{19}$ passes through winding slots $S_{14}$ and $S_{10}$ to form a coil which winds about the teeth between winding slots $S_{14}$ and $S_{10}$, and then the wire is connected to segment $Z_2$, which is adjacent to segment $Z_1$. In other words, segment $Z_1$ is electrically connected to segment $Z_2$ by two coils which are connected in series and connected to a shared segment $Z_{19}$, which is substantially under the same polarity as segment $Z_1$. As used in the specification and the appended claims, two or more segments under the same polarity means that the two or more segments are separated from each other by the distance between poles of same polarity. As is known, for a motor having 2P stator poles and a commutator of m segments, the distance between poles of the same polarity measured in the number of segments is equal to m/P. For simplicity, the m segments are referred to as segments $Z_1, Z_2, \ldots, Z_x, Z_y, \ldots Z_m$, wherein $1 \le x \le m$ and $1 \le y \le m$. Segment $Z_x$ and $Z_y$ should be under the same polarity if $|y-x|$ is equal to m/P or a multiple of m/P. Referring back to FIG. 3, the motor according to the preferred embodiment has 4 or 2×2 stator poles and 36 segments, and segments $Z_x$ and $Z_y$ are under the same polarity if $|y-x|$ equal to 36/2 or 18.

Segment $Z_Z$ is electrically connected to segment $Z_3$ by a winding unit which comprises two coils connected in series. One of the two coils is wound about the teeth between the winding slots $S_6$ and $S_{10}$, and the other coil is wound about the teeth between the winding slots $S_{15}$ and $S_1$. The two coils are also connected to a shared segment $Z_{20}$ which is under the same polarity as segment $Z_2$.

Similar to the electrical connection of segment $Z_1$ and $Z_2$, segment $Z_3$ is electrically connected to segment $Z_4$ by a winding unit which comprises two coils connected in series. One of the two coils is wound about the teeth between the winding slots $S_6$ and $S_2$, and the other coil is wound about the teeth between the winding slots $S_{15}$ and $S_{11}$. The two coils are also connected to a shared segment $Z_{21}$ which is under the same polarity as segment $Z_3$.

Similar to the electrical segment $Z_2$ and $Z_3$, segment $Z_4$ is electrically connected to segment $Z_5$ by a winding unit which comprises two coils connected in series. One of the two coils is wound about the teeth between the winding slots $S_7$ and $S_{11}$, and the other coil is wound about the teeth between the winding slots $S_{16}$ and $S_2$. The two coils are also connected to a shared segment $Z_{22}$ which is under the same polarity as segment $Z_4$. And so on.

In other words, every two adjacent segments are electrically connected by a winding unit. In most cases, the winding unit comprises two coils connected in series. However, segments $Z_{18}$ and $Z_{19}$ are electrically connected by a winding unit comprising three coils connected in series, and segment $Z_{36}$ and $Z_1$ are electrically connected by a winding unit comprising only one coil.

In other words, for a motor comprising 2P stator poles and a commutator of m segments $Z_1 \sim Z_m$, where P is an even integer greater than 1 and m is a multiple of P, every two adjacent segments are connected by a winding unit, so that the rotor winding has m winding units, wherein:

(1) the winding unit connected to segments $Z_m$ and $Z_1$ has only one coil;

(2) for $1 \le x$, $x+1 \le m$ and x is multiple of m/P, the winding unit connected to segments $Z_x$ and $Z_{x+1}$ has P+1 coils connected in series. Every two adjacent coils of the winding unit are connected to a shared segment that is under the same polarity as segment $Z_x$ or $Z_{x+1}$; it should be understood that there are P−1 such winding units; and (3) for $1 \le x$, $x+1 \le m$ and x is not a multiple m/P, the winding unit connected to segments $Z_x$ and $Z_{x+1}$ has P coils connected in series, and every two adjacent segments of the winding unit P coils are connected to a shared segment that is under the same polarity as segment $Z_x$ or $Z_{x+1}$. It should be understood that there are m−P such winding units.

In addition, the coil pitch (referred to hereafter as q) is preferably equal to the pole pitch as much as possible to improve the motor's performance and to shorten the lead wires of the coils. For a motor having a stator of 2P stator poles and a rotor of n teeth, a pole pitch is expressed as n/2P. The coil pitch q preferably satisfies the equation $|q-n/2P|<1$. For the exemplary motor shown in FIG. 3, the pole pitch is equal to 18/4 or 4.5, and the coil pitch q is 4.

Further more, as mentioned, for the winding unit connected to segment $Z_x$ and $Z_{x+1}$ and comprising more than one coil, every two adjacent coils are connected to a shared segment $Z_y$ which is under the same polarity as segment $Z_x$ or $Z_{x+1}$. That is, $|y-x|$ equal to a multiple of m/P or $|(x+1)-y)|$ equal to a multiple of m/P. Along one circumferential direction of the commutator, the distance from segment $Z_x$ to segment $Z_y$ is not equal to the distance from segment $Z_y$ to segment $Z_{x+1}$. For example, the winding unit connected to segment $Z_1$ and $Z_2$ comprises two coils, and the two coils are connected to a shared segment $Z_{19}$. From a circumferential direction of segment $Z_1$-segment $Z_{19}$-segment $Z_2$, there are seventeen segments $Z_2 \sim Z_{18}$ between segment $Z_1$ and segment $Z_{19}$, and there are eighteen segments $Z_{20} \sim Z_{36} \sim Z_1$ between segment $Z_{19}$ and segment $Z_2$.

Further more, the winding direction of the coils of the same winding unit is the same, for example, wound in clockwise or counter-clockwise direction. However, for the two winding units connected to adjacent three segments respectively, winding direction of coils of the first winding unit is different from winding direction of coils of the second winding unit. This is because the two winding units are under different polarity. For example, the coils of the winding unit connected to segment $Z_1$ and $Z_2$ are wound in clockwise direction, while coils of the winding unit connected to segment $Z_2$ and $Z_3$ are wound in the counter-clockwise direction.

FIG. 9 is a winding table illustrating the connection relationships of a rotor winding, winding slots, and segments according to another embodiment of the present invention. The motor comprises two brushes, a stator with four poles (2P=4), a rotor with 26 teeth (n=26) and a commutator with 52 segments (m=52). For simplicity, the 52 segments are named segments $Z_1$ to $Z_{52}$ respectively. The winding scheme has the following features:

(1) every two adjacent segments are electrically connected by a winding unit comprising one coil or more than one coil connected in series, and both ends of each coil are directly connected to corresponding segments;

(2) for $1 \le x$, $x+1 \le m$ and x is not multiple of m/P, the winding unit connected to segment $Z_x$ and $Z_{x+1}$ comprises P coils connected in series, and every two adjacent coils of the winding unit are connected to a shared segment that is under the same polarity as segment $Z_x$ or $Z_{x+1}$; the number of such winding units is m−P;

(3) the winding unit connecting segment $Z_m$ to segment $Z_1$ comprises only one coil;

(4) for $1 \le x$, $x+1 \le m$ and x is multiple of m/P, the winding unit connecting segments $Z_x$ and $Z_{x+1}$ comprises P+1 coils connected in series, and every two adjacent coils of the winding unit are connected to a shared segment that is under the same polarity as segment $Z_x$ or $Z_{x+1}$; the number of such winding units is P−1; and (5) each coil has a coil pitch approximately equal to one pole pitch, the pole pitch being expressed as in/2P.

FIG. 10 illustrates another winding table according to a further embodiment of the present invention. The motor comprises a stator with 6 poles (2P=6) and two brushes, a rotor with a rotor core of 27 teeth (n=27) and a commutator of 54 segments (m=54). For simplicity, the 54 segments are named segments $Z_1$ to $Z_{54}$ respectively. The winding scheme shown in FIG. 10 also has similar features to the winding scheme shown in FIG. 9.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A blower comprising: a case, a motor and an impeller driven by the motor, wherein the case comprises an air inlet, an air outlet, and an air channel communicating the air inlet with the air outlet, the impeller being disposed inside the air channel, wherein the motor comprises a stator and a rotor rotatably mounted to the stator, the stator comprising a stator core which comprises a yoke, P primary poles with stator windings wound thereon and P auxiliary poles, the primary poles and auxiliary poles being alternately arranged on the radially inner side of the yoke in a circumferential direction thereof, when the stator windings are electrified, P primary magnetic poles and P auxiliary magnetic poles are formed at the primary poles and auxiliary poles, respectively, the polarity of the primary magnetic poles being opposite to the polarity of the auxiliary magnetic poles, P being an integer greater than one;

wherein the rotor comprises a shaft, a rotor core, a rotor winding comprising m winding units where m is an even integer greater than P, and a commutator fixed onto the shaft;

wherein the commutator comprises m segments, every two adjacent segments of the m segments being electrically connected together by a winding unit; and at least one of the m winding units comprises P coils connected in series, and opposite ends of each coil are directly connected to corresponding two of the m segments.

2. The blower of claim 1, wherein for the winding unit connected to first segment $Z_X$ and an adjacent second segment $Z_{X+1}$ and comprising more than one coil, every two adjacent coils of the winding unit is directly connected to a shared segment $Z_Y$ which is under the same polarity as the first segment $Z_X$ or the second segment $Z_{X+1}$.

3. The blower of claim 2, wherein additional windings are wound on the auxiliary poles, the additional windings wound about each auxiliary pole having less turns than the stator windings wound about each primary pole.

4. The blower of claim 2, wherein the outer diameter D of the rotor core and the minimum outer diameter Y of the stator core meets the following equation: D/Y>6:10.

5. The blower of claim 2, wherein the yoke comprises P primary yoke portions from which the primary poles extend inwardly and P auxiliary yoke portions from which the auxiliary poles extend inwardly.

6. The blower of claim 5, wherein holes are formed in the auxiliary yoke portions.

7. The blower of claim 5, wherein the radial thickness of each primary yoke portion is larger than the radial thickness of each auxiliary yoke portion.

8. The blower of claim 1, wherein m is a multiple of P, and the rotor core comprises n teeth, wherein n is a multiple of P and is greater than P.

9. The blower of claim 2, wherein there are no stator windings wound about the auxiliary poles.

10. The blower of claim 2, wherein each of the primary poles and auxiliary poles comprises a neck portion inwardly extending from the yoke and an arc shape pole shoe which confronts the rotor; the radial length of the neck portion of each primary pole is larger than the radial length of the neck portion of each auxiliary pole.

11. The blower of claim 2, wherein the blower comprises an axial fan driven by the motor to generate an axial flow of air towards the motor, the axial fan and the impeller being respectively disposed at opposite ends of the motor.

* * * * *